US008074825B1

(12) United States Patent
Ziegler

(10) Patent No.: US 8,074,825 B1
(45) Date of Patent: Dec. 13, 2011

(54) DISPENSING CLOSURE FOR SELECTIVELY DISPENSING MATERIAL FROM A MULTI-CHAMBERED CONTAINER

(76) Inventor: Robert A. Ziegler, E. Windsor, NJ (US)

( * ) Notice: Subject to any disclaimer, the term of this patent is extended or adjusted under 35 U.S.C. 154(b) by 553 days.

(21) Appl. No.: 12/204,790

(22) Filed: Sep. 4, 2008

Related U.S. Application Data

(60) Provisional application No. 60/967,298, filed on Sep. 4, 2007.

(51) Int. Cl.

| | |
|---|---|
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |

(52) U.S. Cl. ..... 220/523; 215/387; 222/132; 222/145.1; 222/144.5; 206/219; 137/625.41

(58) Field of Classification Search ..... 206/221, 206/568, 219; 220/523, 560.03, 563, 564, 220/584, 500, 501; 215/DIG. 8, 387, 388; 222/145.1, 145.5, 94, 132; 239/61; 137/625.41
See application file for complete search history.

(56) References Cited

U.S. PATENT DOCUMENTS

| | | | | |
|---|---|---|---|---|
| 3,217,931 | A * | 11/1965 | Farrar et al. | 222/94 |
| 3,876,112 | A * | 4/1975 | Kramer | 222/132 |
| 4,522,233 | A * | 6/1985 | Mojadad | 137/625.47 |
| 6,308,862 | B1 | 10/2001 | Fillmore et al. | |
| 6,752,264 | B2 | 6/2004 | Versluys | |
| 7,594,594 | B2 * | 9/2009 | Troost et al. | 222/145.5 |
| 2006/0021996 | A1 * | 2/2006 | Scott et al. | 222/145.5 |
| 2006/0102656 | A1 * | 5/2006 | Troost et al. | 222/132 |
| 2006/0289563 | A1 * | 12/2006 | Ziesel | 222/145.1 |

* cited by examiner

*Primary Examiner* — Mickey Yu
*Assistant Examiner* — Rafael Ortiz
(74) *Attorney, Agent, or Firm* — LaMorte & Associates, P.C.

(57) ABSTRACT

A container assembly with a closure and the structure of the closure. The container has multiple compartments for holding different materials. The container has a closure with a fitment that attaches to the container. The fitment has separate bottom receptacle areas on one side and a top receptacle on the other. The separate receptacle areas are each exposed to different compartments within the container. The top receptacle area is connected to each of the separate receptacle areas by conduits. A selection head is provided having a pour spout and a plurality of baffle chambers. The pour spout has an open central conduit, wherein only some of the baffle chambers are open to that central conduit. The baffle chambers are received within the top receptacle area of the fitment. Different combinations of the baffle chambers selectively align with different conduits as the selection head rotates within the fitment.

17 Claims, 5 Drawing Sheets

DISPENSING CLOSURE FOR SELECTIVELY DISPENSING MATERIAL FROM A MULTI-CHAMBERED CONTAINER

RELATED APPLICATIONS

This application claims priority of co-pending provisional patent application No. 60/967,298, entitled Multi-sided Multi-chambered Flexible Package With Fitment, filed Sep. 4, 2007

BACKGROUND OF THE INVENTION

1. Field of the Invention

In general, the present invention relates to closures of the type used on containers that hold liquid products. More particularly, the present invention relates to closures where the liquid product is dispensed through the structure of the closure. The present invention also relates to closures for containers that have multiple compartments.

2. Prior Art Description

Many consumer products are packaged in multi-chambered containers. A multi-chambered container is a container that is compartmentalized into separate compartments. Each of the compartments is filled with a distinct material. The various materials can therefore be selectively dispensed from a single container.

There are many reasons for packaging different materials into different compartments of a single container. For certain products, such as epoxy adhesives, cleaning fluids, and other reactive compounds, the storage of different material in different compartments is required to prevent chemical reactions from occurring between the compounds. For other products, multi-chambered containers are used merely to provide a consumer with a selective control in dispensing the various materials within the container.

Multi-chambered containers exist in many forms. For example, there are multi-chambered bottle containers made of both plastic and glass. There are also multi-chambered pouch containers and bag containers. Regardless of the structure of the multi-chambered container, the closure for that container typically falls into one of two types. The first type of closure is a dedicated closure. That is, each chamber within the multi-chambered closure has its own closure. Individual compartments can therefore be opened and closed as desired. For example, a shaker container may have both a salt compartment and a pepper compartment. A person can dispense either salt or pepper by opening the closure over the desired compartment.

The second type of closure is a mixing closure. A mixing closure mixes the materials from different compartments as those materials exit the container. The materials can mix just as they exit the closure, such as is exemplified by U.S. Pat. No. 6,308,862 to Fillmore, entitled Dispensing Package For Dual Viscous Products. Alternatively, the materials can mix within the closure, prior to being dispensed, as is exemplified by U.S. Pat. No. 6,752,264 to Versluys, entitled Flexible Pouch Having System For Mixing Two Components.

In the first type of prior art closure, a person can select materials from the different compartments, but those materials cannot be intermixed prior to being dispensed. In the second type of prior art closure, the material can be intermixed prior to dispensing, but the choice of materials in the mixture cannot be selected.

The present invention is a closure and a container with a closure that combines the advantages of both types of prior art closures. The present invention enables a person to select materials from different chambers in a container and then mixes and dispenses only the materials that were selected. The present invention is described and claimed below.

SUMMARY OF THE INVENTION

The present invention is a container assembly with a closure and the structure of the closure. The container has multiple compartments for holding different materials. The container has a closure, wherein all the materials from all of the compartments are dispensed through the structure of the closure.

The closure itself contains a fitment that attaches to the multi-chambered container. The fitment has a partition that separates a plurality of separate receptacle areas on one side from a mixing receptacle on the other. The separate receptacle areas are each exposed to different compartments within the multi-chambered container. The mixing receptacle area is connected to each of the separate receptacle areas by conduits that extend through the partition.

A selection head is provided having a pour spout and a plurality of baffle chambers. The pour spout has an open central conduit, wherein only some of the baffle chambers are open to that central conduit. The baffle chambers are received within the mixing receptacle area of the fitment. Different combinations of the baffle chambers selectively align with different conduits as the selection head rotates within the fitment. In this manner a person can select which of materials from which of the multiple chambers is to be dispensed through the pour spout.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be embodied as a container for many types of materials, such as thick flow adhesives, powders, granulated food products and the like, the present invention is especially well suited for holding, mixing and dispensing liquid products. Accordingly, in the exemplary embodiment, the present invention is configured as a beverage container that holds different consumable liquids. The exemplary embodiment is intended to represent one of the best modes contemplated of the invention and should not be considered a limitation upon the claims.

Figure 1:
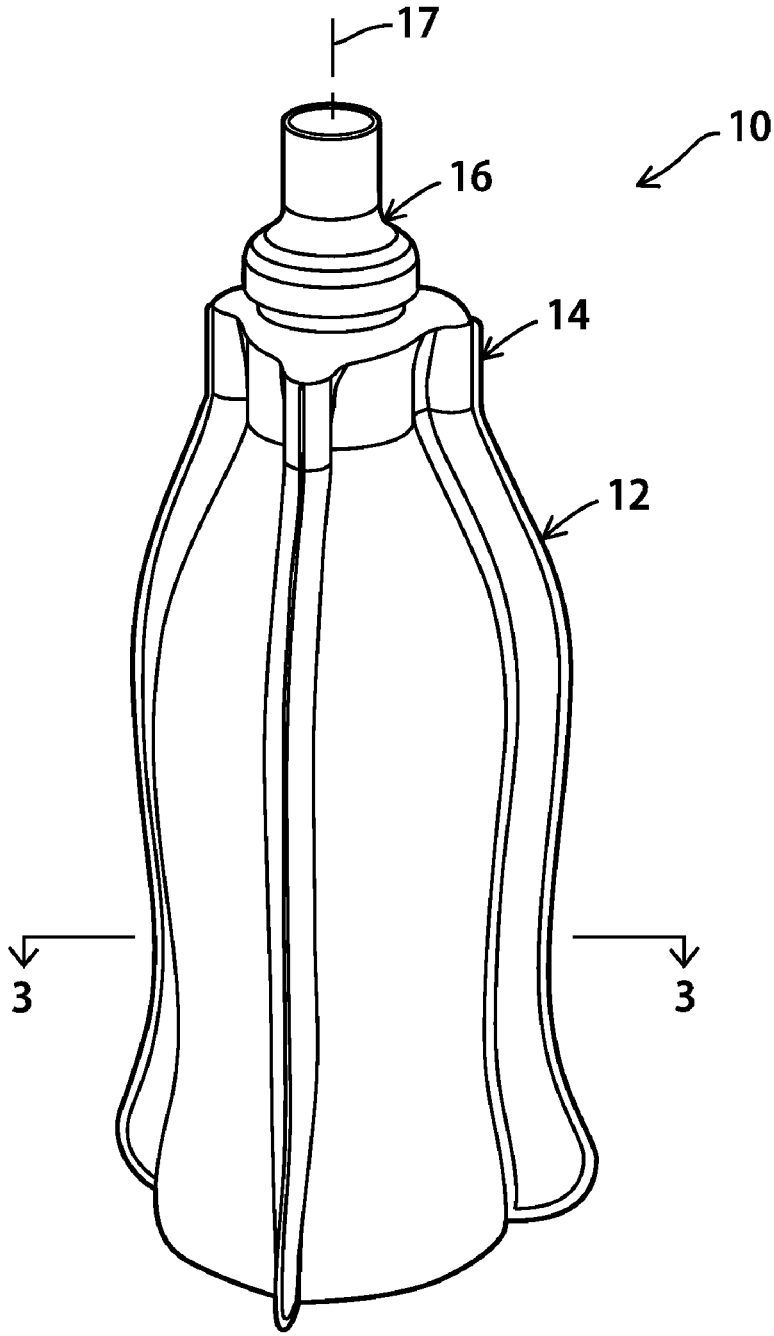
FIG. 1 is a perspective view of an exemplary embodiment of a container assembly.

Referring to FIG. 1, there is shown a beverage container assembly 10. The beverage container assembly 10 contains a multi-chambered container 12, a fitment 14 and a selection head 16. As will be explained, the multi-chambered container 12 has multiple internal compartments. Each compartment can be filled with a separate liquid. Each compartment feeds liquids into the fitment 14 when the beverage container assembly 10 is inverted, tipped, squeezed, or pressurized for dispensing. The separation between the various liquids in the various compartments is maintained within the fitment 14.

The selection head 16 interconnects with the fitment 14. The selection head 16 can be selectively rotated about a central axis 17. As the selection head 16 is rotated, it provides open access to the various compartments within the multi-chambered container 12 in any combination. For example, if the multi-chambered container 12 has four separate compartments, the selection head 16 can access any combination of the four compartments. When the beverage container assembly 10 is tilted or inverted, the compartments selectively accessed by the selection head 16 are enabled to intermix and dispense from the beverage container assembly 10.

Figure 2:
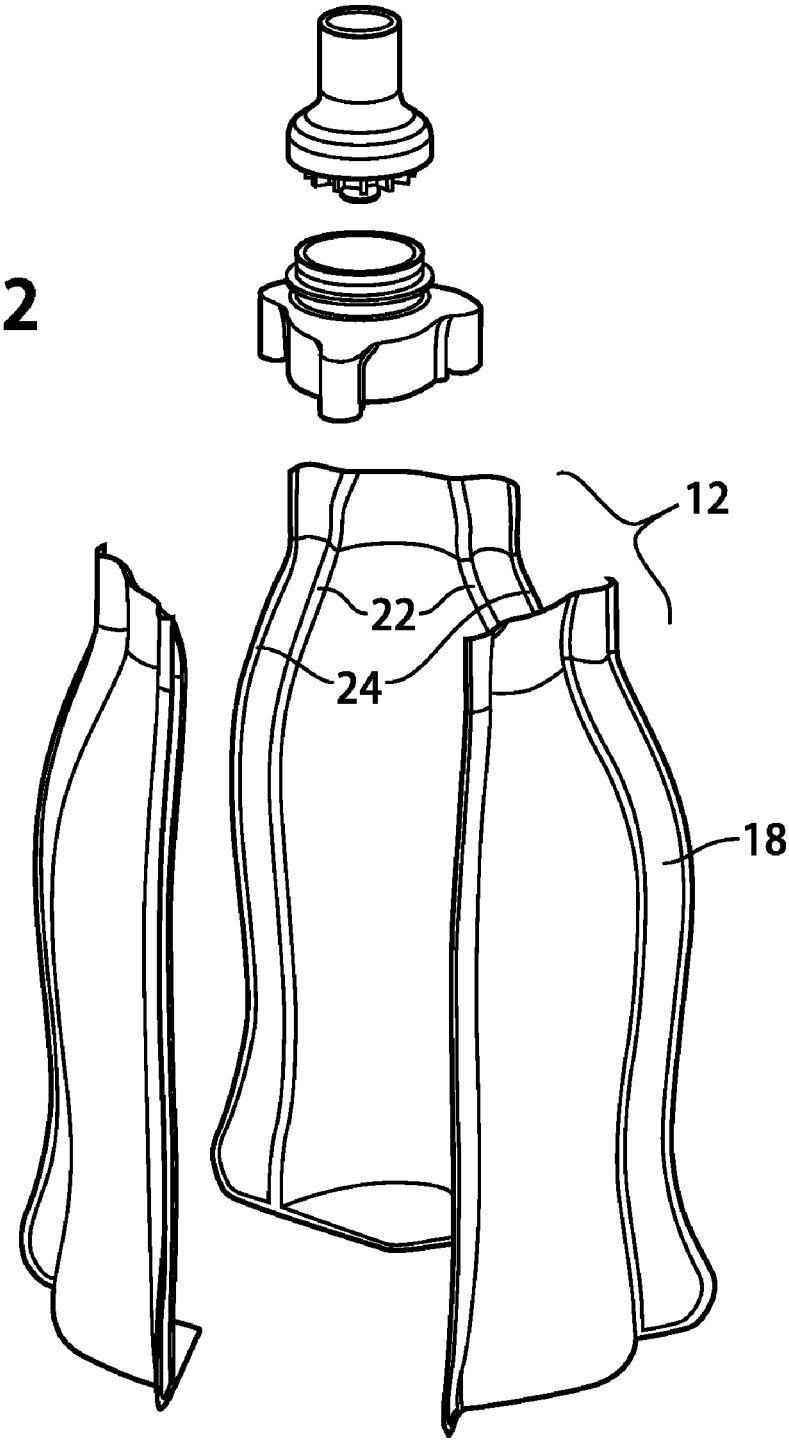
FIG. 2 is an exploded view of the embodiment of FIG. 1.
Figure 3:
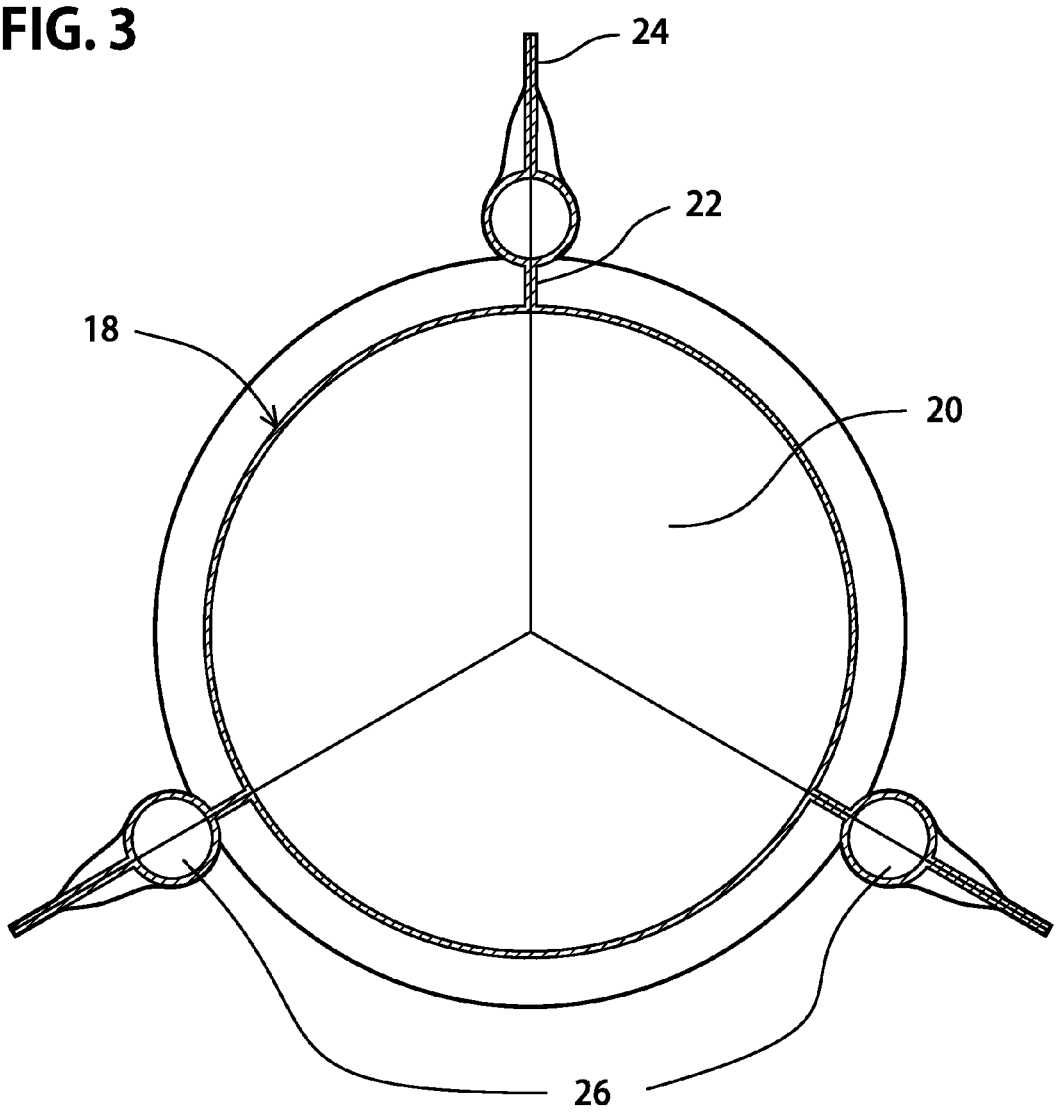
FIG. 3 is a cross-sectional view of the multi-chambered container component, viewed from section line 3-3 in FIG. 1.

Referring to FIG. 2 in conjunction with FIG. 3, it can be seen that the selected multi-chambered container 12 is a pouch container. That is, it is a container made from multiple panels 18 of plastic film that are bonded together along seams. The selection of such a construction is merely exemplary. Multi-chambered containers of molded plastic, glass, metal, paper, or the like may be substituted.

In the shown embodiment, three panels 18 of plastic film are provided. Each panel 18 of plastic film has a set of inner seams 22 and a set of outer seams 24. The inner seams 22 of adjacent panels are bonded together. This forms one large central compartment 20. Additionally, the outer seams 24 of adjacent panels are bonded together. This forms three isolated outer compartments 26. Both the large central compartment 20 and the three smaller outer compartments 26 each have closed bottom ends and open top ends.

In the shown embodiment, three panels 18 are used to make a container 12 with one large central compartment 20 and three outer compartments 26. It should be understood that any number of panels 18 greater than two can be used. By varying the number of panels 18 and seams 22, the number of outer compartments 26 can be increased or decreased. In addition, the central compartment 20 may be eliminated altogether by extending the seams 22 to meet central axis 17.

Figure 4:
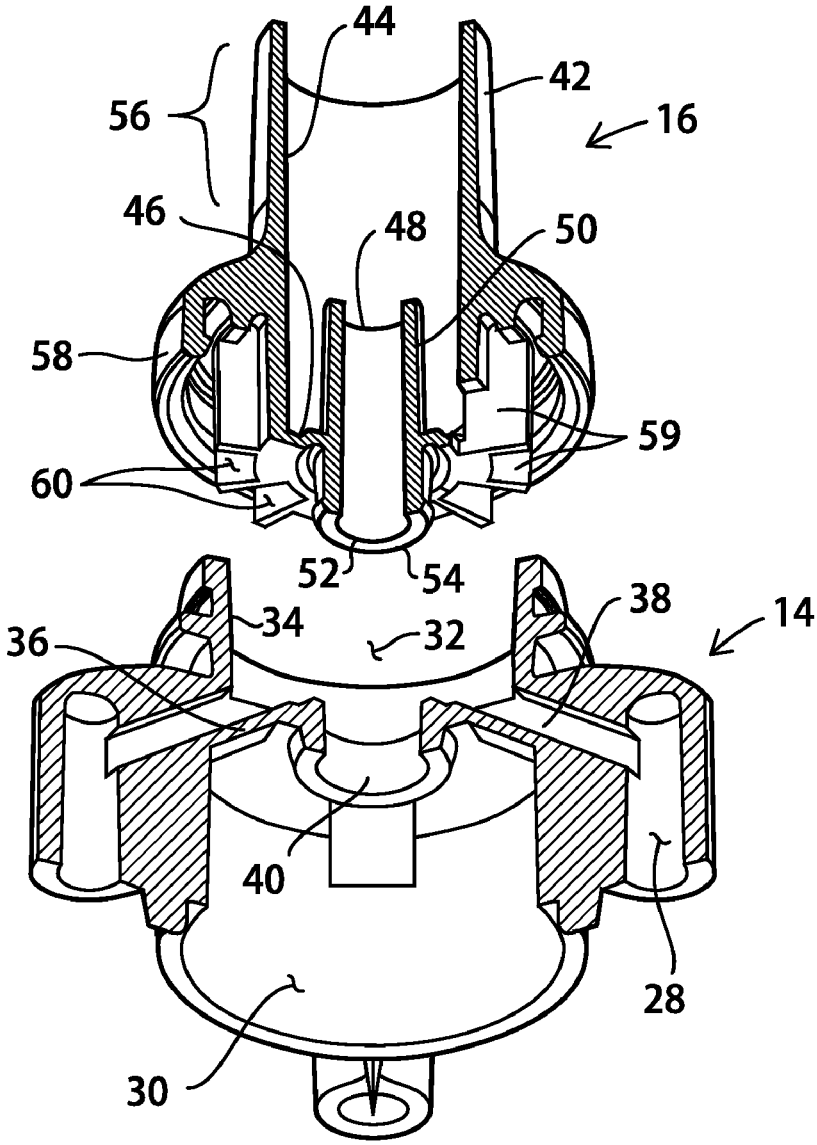
FIG. 4 is an exploded cross-sectional view of the closure component.

Referring to FIG. 4, the exemplary structure of the fitment 14 and selection head 16 are described. The fitment 14 attaches to the multi-chamber container 12. The fitment 14 defines four bottom receptacle areas. The four bottom receptacle areas include a large central receptacle area 30 and three smaller outside receptacle areas 28. The central receptacle area 30 communicates with the central compartment 20 (FIG. 3) in the multi-chambered container 12. Likewise, the three smaller outside receptacle areas 28 communicate with the three outside compartments 26 in the multi-chambered container 12.

A single top receptacle area 32 is disposed on the top of the fitment 14. The top receptacle area 32 is defined by a cylindrical wall 34 that is open at its top. The top receptacle area 32 is separated from the bottom central receptacle area 30 by a partition wall 36. The partition wall 36 serves as the bottom surface of the top receptacle area 32 and the top surface of the bottom central receptacle area 30.

Both the bottom central receptacle area 30 and the outside receptacle areas 28 communicate with the top receptacle area 32. The bottom central receptacle area 30 on the bottom of the fitment 14 communicates with the top receptacle area 32 through an aperture 40 that extends through the center of the partition wall 36. Each of the outer receptacle areas 28 communicates with the top receptacle area 32 through narrow conduits 38. The narrow conduits 38 intersect the top receptacle area 32 at the base of the cylindrical wall 34.

The selection head 16 is a molded plastic component that interconnects with the fitment 14. The selection head 16 has a pour spout 42 with an open top end 43. Material from within the multi-chambered container 12 flows out of the beverage container assembly 10 through the pour spout 42 when the beverage container assembly 10 is tilted or otherwise inverted.

The pour spout 42 has a cylindrical interior wall 44 and a bottom surface 46. A tubular structure 50 is disposed in the center of the bottom surface 46. The tubular structure 50 has an open top end 48 and an open bottom end 52. The top end 48 of the tubular structure 50 terminates inside the pour spout 42 above the bottom surface 46 of the pour spout 42. The top end 48 of the tubular structure 50 extends at least one-quarter of the way up inside the pour spout 42 from the bottom surface 46. The bottom end 52 of the tubular structure 50 also extends below the bottom surface 46 of the pour spout 42. A locking ridge 54 is formed around the exterior of the tubular structure 50 at its bottom end 52.

In the shown embodiment, the tubular structure 50 is unobstructed. In an alternate embodiment, the tubular structure 50 can contain a one-way flow valve that permits flow of materials only from it bottom end 52 toward its top end 48.

The exterior of the pour spout 42 has a short cylindrical section 56. The cylindrical section 56 transitions into a much wider flare ring 58. The flare ring 58 engages the cylindrical wall 34 that defines the top receptacle area 32. However, once engaged, the flare ring 58 is still free to rotate relative to the cylindrical wall 34.

A plurality of baffle walls 59 are disposed under the flare ring 58. The baffle walls 59 define a plurality of baffle chambers 60. Some baffle chambers 60 have openings that lead into the interior of the pour spout 42, some do not.

Figure 5:
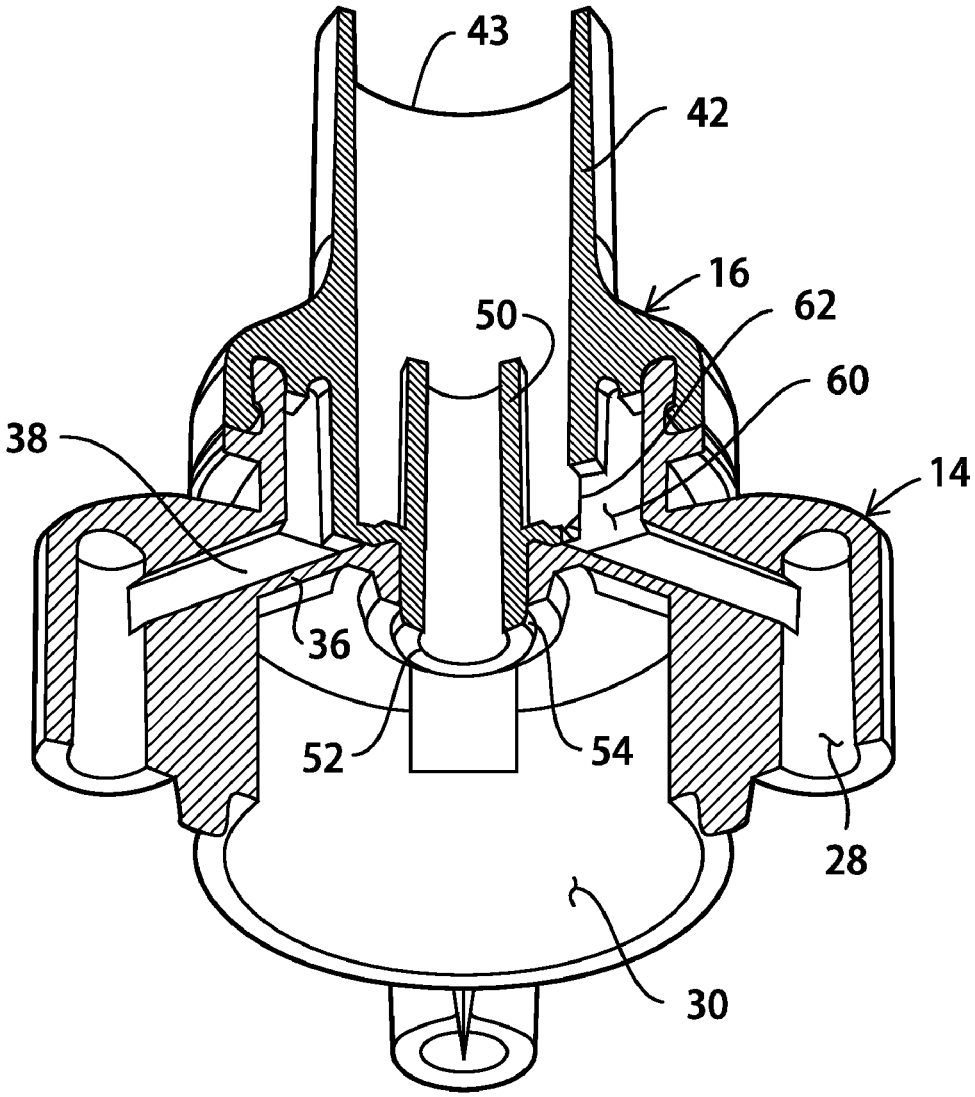
FIG. 5 is a cross-sectional view of the closure component shown assembled.

Referring to FIG. 5 in conjunction with FIG. 4, it will be understood that the selection head 16 and the fitment 14 mechanically interconnect. The bottom end 52 of the tubular structure 50 enters the central aperture 40 in the partition wall 36 of the fitment 14. The locking ridge 54 on the bottom end 52 of the tubular structure 50 snaps through the central aperture 40 and engages the partition wall 36 around the central aperture 40. This mechanically interconnects the selection head 16 with the fitment 14. However, it leaves the fitment 14 free to rotate about is central axis independently of the fitment 14.

In the exemplary embodiment, the fitment 14 has a bottom central receptacle area 30 and three smaller outside receptacle areas 28. The outside receptacle areas 28 interconnect with the top receptacle area 32 of the fitment 14 through side conduits 38. When the selection head 16 is attached to the fitment 14, the side conduits 38 align with the various baffle chambers 60 that are defined by the baffle walls 59. Some of the baffle chambers 60 have openings 62 that lead to the interior of the pour spout 42, some do not.

By rotating the selection head 16 within the fitment 14, it will be understood that different baffle chambers 60 can be selectively aligned with different side conduits 38. The baffle chambers 60 are configured so that any combination of side conduits 38 can be blocked from the pour spout 42 or connected to the pour spout 42. Accordingly, in the exemplary embodiment, by rotating the selection head 16, one, two or all three of the outside receptacle areas 28 can be interconnected, or isolated from, the pour spout 42.

Once an outside receptacle area 28 from the fitment 14 is interconnected with the pour spout 42, any material in the multi-chambered container 12 that is exposed to that outside receptacle area 28 is free to pour through the fitment 14 and out of the pour spout 42. Once the beverage container assembly 10 is again brought upright, any residual fluids in the pour spout 42 are prevented from returning through the fitment 14 and into the central compartment 20 by the elevated configuration of the tubular structure 50 at the bottom of the pour spout 42.

Returning now to FIG. 1, the method of operation for the beverage container assembly 10 can be described. The different compartments in the multi-chambered container 12 are filled with different fluids. For instance, the large central compartment 20 may be filled with water. The smaller outside compartments 26 can be filled with different flavored syrups.

A user selects what syrups, if any, he/she wants to mix with the water. The user rotates the selection head 16 so that the desired selections are enabled. When the beverage container assembly 10 is tipped, the selected fluids all flow into the pour spout 42. The selected fluids then intermix as they pour from the pour spout 42.

It will be understood that the embodiment of the present invention that is illustrated and described is merely exemplary and that a person skilled in the art can make many variations to that embodiment. For instance, the number of compartments in the assembly can be any number greater than two. The shape of the multi-chambered container is a matter of design choice, as is the shape of the fitment and selection head. All such variations, modifications, and alternate embodiments are intended to be included within the scope of the claims.

What is claimed is:

1. A closure for a container having multiple compartments, said closure comprising:

a fitment having a partition, a plurality of separate bottom receptacle areas below said partition and a top receptacle area above said partition, wherein each of said plurality of separate receptacle areas is exposed to a different one of said multiple compartments in said container, and wherein said top receptacle area is connected to each of said plurality of separate receptacle areas by conduits that extend through said partition;

a selection head having a pour spout and a plurality of baffle chambers, wherein said pour spout has an open central conduit and wherein only some of said baffle chambers are open to said central conduit;

wherein said baffle chambers are received within said top receptacle area of said fitment and different combinations of said baffle chambers selectively align with different of said conduits at different rotational positions as said selection head rotates relative to said fitment, therein enabling any different combinations of said bottom compartments to be open to said pour spout depending upon which of said different rotational positions is selected.

2. The closure according to claim 1, wherein said plurality of separate bottom receptacle areas of said fitment include a central bottom receptacle area and outside bottom receptacle areas that surround said central bottom receptacle area.

3. The closure according to claim 2, wherein said central receptacle area is open to said pour spout without obstruction by said baffle chambers in all of said different rotational positions.

4. The closure according to claim 3, wherein a tubular element interconnects said central receptacle area and said pour spout.

5. The closure according to claim 4, wherein said tubular element extends upwardly in said pour spout.

6. The closure according to claim 4, wherein said tubular element has a bottom end that extends downwardly and terminates below said baffle chambers.

7. The closure according to claim 6, wherein said tubular element is received by said fitment whereby said tubular element mechanically interconnects said selection head to said fitment.

8. A container assembly, comprising:

a container having an open top, said container being compartmentalized into a plurality of compartments that are all exposed to said open top, wherein said plurality of compartments includes a central compartment that is surrounded by a plurality of outside compartments; and a closure that covers said open top, said closure having a fitment that engages said container and a rotatable section that can be rotated relative to said fitment through different rotational positions, wherein said rotatable section has a pour spout that interconnects through said fitment with different combinations of said plurality of compartments as said rotatable section is rotated relative to said fitment through different rotational positions.

9. The assembly according to claim 8, wherein said plurality of compartments includes a central compartment that is surrounded by a plurality of outside compartments.

10. The assembly according to claim 9, wherein said central compartment is in direct communication with said pour spout through said fitment.

11. The assembly according to claim 8, wherein said container is a pouch container comprised of plastic film sections that are interconnected along seams.

12. The assembly according to claim 9, wherein said fitment has a partition, a plurality of separate bottom receptacle areas on one side of said partition and a top receptacle area in an opposite side of said partition, wherein each of said plurality of separate bottom receptacle areas is exposed to a different one of said compartments in said container, and wherein said top receptacle area is connected to each of said plurality of separate bottom receptacle areas by conduits that extend through said partition.

13. The assembly according to claim 12, wherein said rotatable section further includes a plurality of baffle chambers, wherein said pour spout has an open central conduit and wherein only some of said baffle chambers are open to said central conduit;

wherein said baffle chambers are received within said top receptacle area of said fitment and different combinations of said baffle chambers selectively align with different of said conduits as said rotatable section rotates relative to said fitment through different rotational positions.

14. The assembly according to claim 13, wherein a tubular element interconnects said central compartment to said pour spout.

15. The closure according to claim 14, wherein said tubular element extends upwardly in said pour spout.

16. The closure according to claim 14, wherein said tubular element is received by said fitment whereby said tubular element mechanically interconnects said rotatable section to said fitment.

17. The closure according to claim 14, wherein said container is a flexible pouch container.

* * * * *